US007907048B1

(12) United States Patent
Werner

(10) Patent No.: US 7,907,048 B1
(45) Date of Patent: Mar. 15, 2011

(54) FIRE EXTINGUISHER ACCESSORY DEVICE PROVIDING VOICE INSTRUCTIONS

(76) Inventor: Jeffrey P. Werner, Marseilles, IL (US)

( * ) Notice: Subject to any disclaimer, the term of this patent is extended or adjusted under 35 U.S.C. 154(b) by 245 days.

(21) Appl. No.: 12/270,262

(22) Filed: Nov. 13, 2008

(51) Int. Cl.
*G08B 3/00* (2006.01)

(52) U.S. Cl. ..... 340/384.1; 340/692; 169/23

(58) Field of Classification Search ..... 340/691.1, 340/692, 571, 384.1, 384.7; 169/23, 51, 169/75
See application file for complete search history.

(56) References Cited

U.S. PATENT DOCUMENTS

| | | | | |
|---|---|---|---|---|
| 3,139,977 | A | 7/1964 | Burdick | |
| 3,893,095 | A * | 7/1975 | DeJong | 169/23 |
| 5,280,385 | A | 1/1994 | Wybrow | |
| 5,366,073 | A | 11/1994 | Turrentine et al. | |
| 5,460,228 | A * | 10/1995 | Butler | 169/30 |
| 5,610,770 | A | 3/1997 | Galiani | |
| 5,999,336 | A | 12/1999 | Yang, Jr. | |
| 6,225,914 | B1 * | 5/2001 | Weng | 340/692 |
| D497,377 | S | 10/2004 | Waggoner et al. | |
| 7,044,295 | B2 | 5/2006 | Sugiyama | |
| 7,126,769 | B1 | 10/2006 | Wu | |
| 2002/0097507 | A1 | 7/2002 | Uriarte | |
| 2005/0117229 | A1 | 6/2005 | Block | |

* cited by examiner

*Primary Examiner* — Jeffery Hofsass

(57) ABSTRACT

A fire extinguisher accessory device for providing oral instructions for using a fire extinguisher comprising a housing, a digital memory circuit disposed inside the housing, wherein the digital memory circuit can provide oral instructions for using the fire extinguisher such as "pull," "aim," "squeeze," and "sweep"; a speaker disposed on the front surface of the housing; an amplifier disposed inside the housing; and a pressure switch operatively connected to the housing via a lead, wherein when the pressure switch is compressed, the digital memory circuit is activated and provides oral instructions for using the fire extinguisher.

3 Claims, 3 Drawing Sheets

FIRE EXTINGUISHER ACCESSORY DEVICE PROVIDING VOICE INSTRUCTIONS

FIELD OF THE INVENTION

The present invention is directed to an accessory device for attaching to a fire extinguisher. More particularly, the present invention is directed to a fire extinguisher accessory device that can provide oral instructions for using the fire extinguisher.

BACKGROUND OF THE INVENTION

Using a fire extinguisher can be a stressful task, particularly if a user is not familiar with operating fire extinguishers. The present invention features a fire extinguisher accessory device that can provide oral instructions for using the fire extinguisher.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
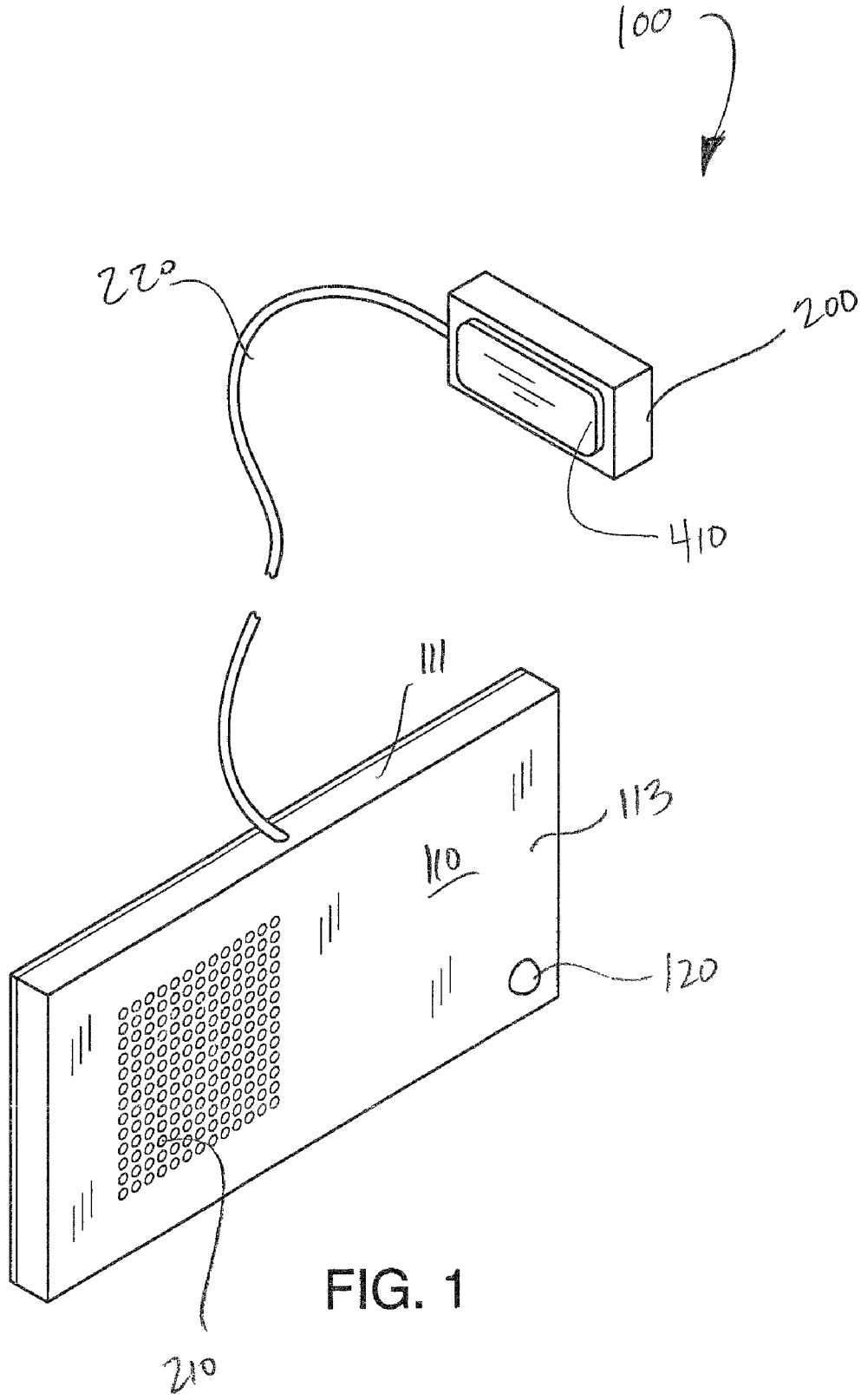
FIG. 1 is a perspective view of the fire extinguisher accessory device of the present invention.
Figure 2:
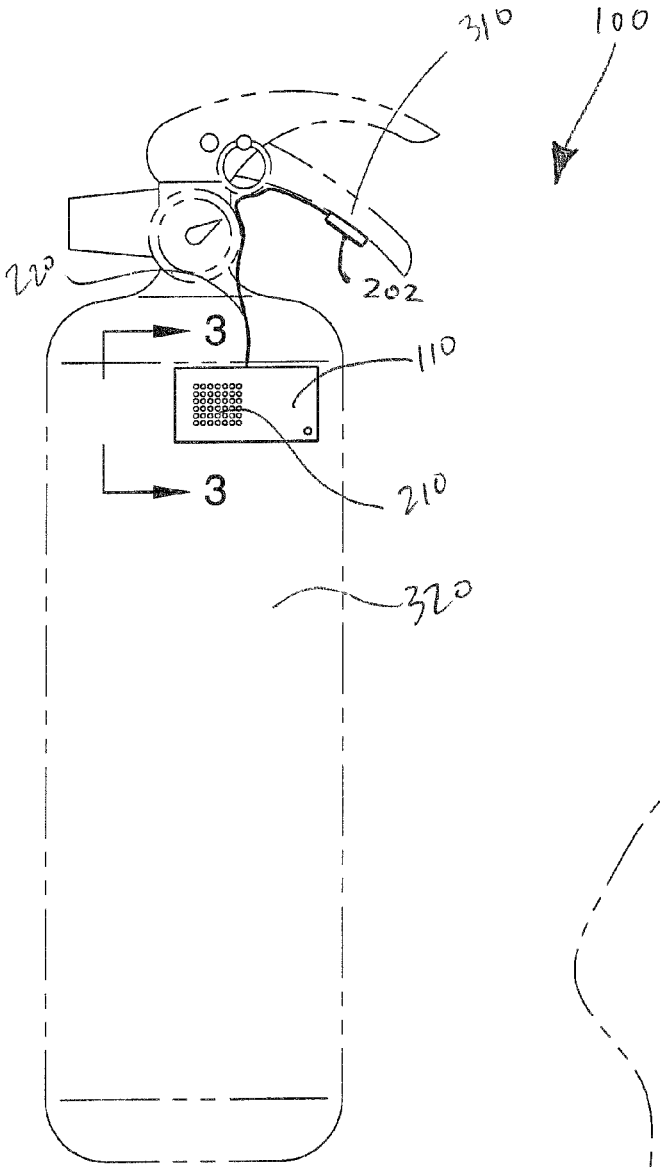
FIG. 2 is a front view of the fire extinguisher accessory device of the present invention.
Figure 3:
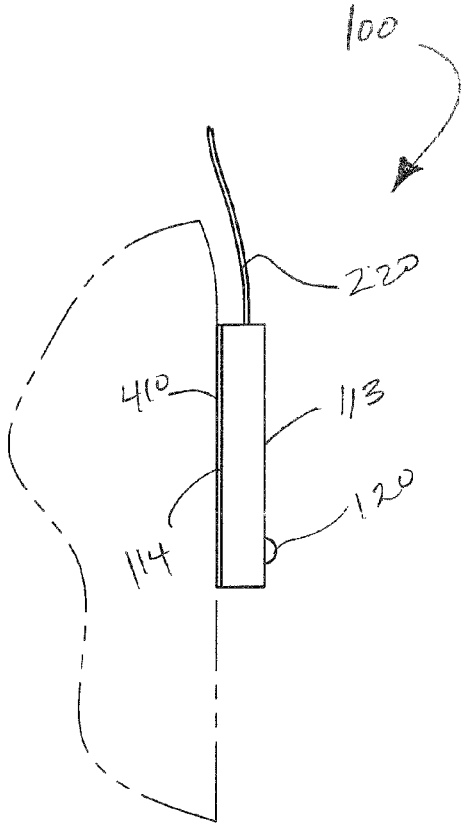
FIG. 3 is a side view of the fire extinguisher accessory device of the present invention.
Figure 4:
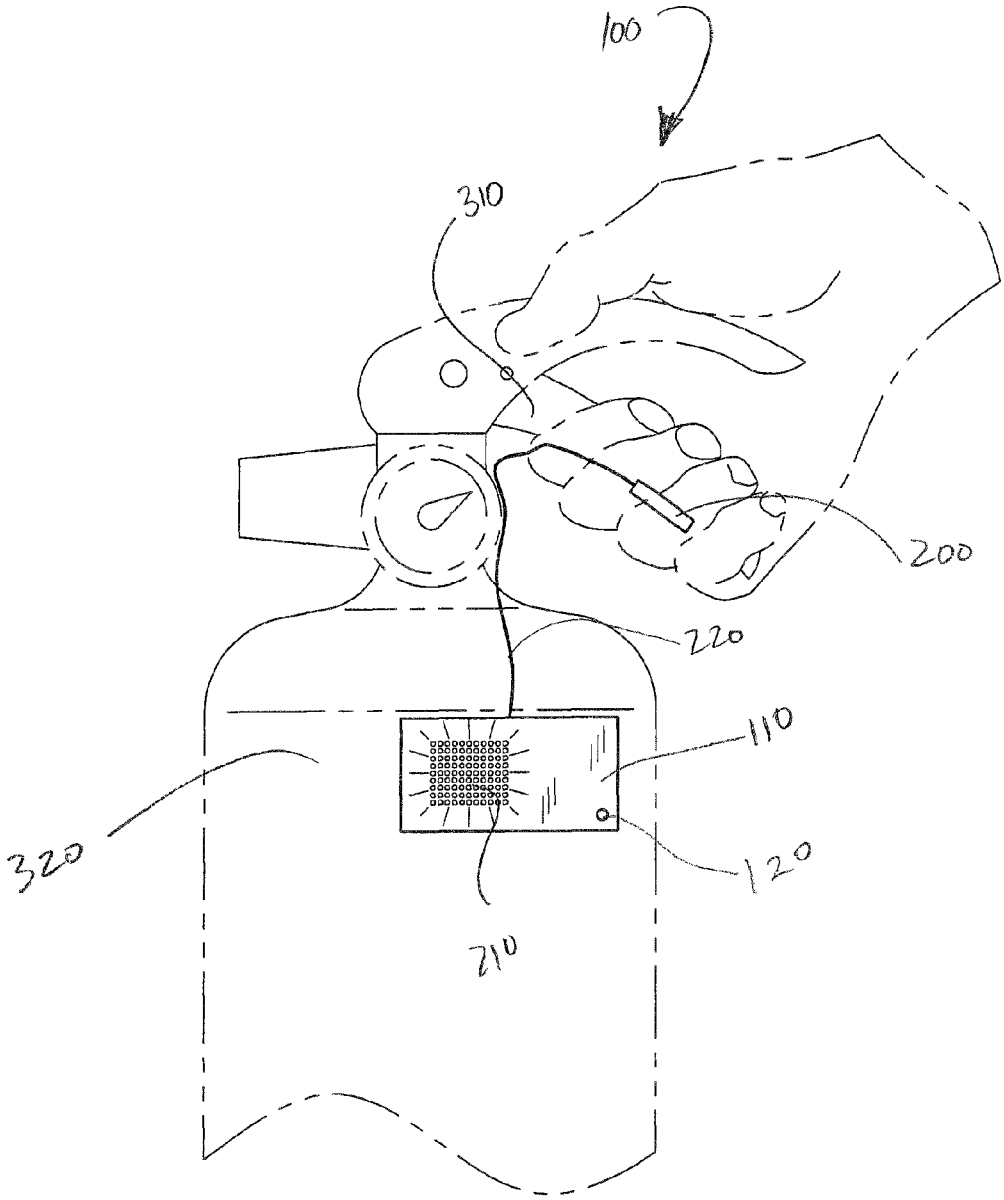
FIG. 4 is a front view of the fire extinguisher accessory device of the present invention.

100 fire extinguisher accessory device
110 housing
111 first side of housing
112 second side of housing
113 front surface of housing
114 back surface of housing
120 light
200 pressure switch
202 pressure pad
220 lead
310 fire extinguisher handle
320 outside surface of fire extinguisher
210 speaker
410 attachment means Referring now to FIGS. 1-4, the present invention features a fire extinguisher accessory device 100 for providing oral instructions for using a fire extinguisher. The fire extinguisher accessory device 100 comprises a housing 110 having a front surface 113, a back surface 114, a first side 111, and a second side 112.

Disposed inside the housing 110 is a central processing unit operatively connected to a battery. The central processing unit (CPU) can provide instructions to a speaker 110 to issue oral instructions for using the fire extinguisher. For example, in some embodiments, the instructions can include "pull," "aim," "squeeze," and "sweep."

Disposed on the front surface of the housing 110 is a speaker. Disposed inside the housing 110 is an amplifier. In some embodiments, the instructions stored on the digital memory circuit are amplified via the amplifier and emitted through the speaker.

The fire extinguisher accessory device 100 further comprises a pressure switch 200 operatively/electrically connected to the housing 110 via a lead 220. The pressure switch 200 is for activating the digital memory circuit. When the pressure switch 200 is compressed (e.g., when a user compresses the handle of the fire extinguisher), the digital memory circuit is activated and provides oral instructions for using the fire extinguisher. For example, in some embodiments, the instructions say "pull safety pin, aim, squeeze, and sweep."

In some embodiments, the present invention features a fire extinguisher accessory device comprising a pressure pad 202, a microprocessor (not shown), a message controller (not shown) and an amplifier (not shown). In some embodiments, the fire extinguisher accessory device is powered by a battery.

The pressure pad 202 is operatively connected as input to said microprocessor. The said microprocessor configured to (a) receive input data from a pressure pad that is actuated;
(b) generate an output control signal as the pressure pad is actuated, wherein the output control signal is operatively connected to said message controller, such that in response the pressure pad being actuated a pre-recorded message is reproduced over said speaker.

In some embodiments, the pre-recorded message says "pull safety pin, aim, spray and sweep" when the pressure pad is actuated. In some embodiments, when the pressure pad is released (i.e., un-actuated), the microprocessor stops generating an output signal and the pre-recorded message stops.

One of ordinary skill can readily design an electrical schematic diagram to implement the schematic described above. See for example, U.S. Pat. No. 6,179,682, the entire disclosure of which is incorporated in its entirety herein by reference. In some embodiments CPU comprises a microprocessor manufactured by Sonix Corp. part no. SN69040M. The inputs may multiplexed onto four discrete inputs P20, P21, P22, and P23 of CPU 164. CPU outputs P 4/0, P 4/1, P 4/2, and P 4/3 comprise the CPU output signal driving message controller. In some embodiments, the output signal comprises a parallel four bit signal input to message controller.

In some embodiments, message controller comprises a sound synthesis chip manufactured by Sonix Corp. part no. SN67060. Message controller includes an integral memory in which a plurality of digitally coded messages may be stored.

In some embodiments, a 5K volume control potentiometer is provided in the speaker output circuit, as is output amplifier.

Other miscellaneous circuit features of the present invention include a 4.5 v battery power source. Power-on indicating power light indicator is connected between the positive supply voltage Vcc and pin of message controller. Thus, power light indicator draws current and is illuminated when Vcc is present and message controller is powered up. The electronic components and circuitry can be mounted on a printed circuit board (not shown) housed within the base of talking iron.

Disposed on the front surface of the housing 110 is a light for indicating the status of the battery. In some embodiments, the light is a light emitting diode (LED). In some embodiments, the light is illuminated when the battery is low.

The housing 110 of the fire extinguisher accessory device 100 can be attached to the outside surface of a fire extinguisher via an attachment means (e.g., adhesive strip, hook-and-loop fastener, the like). In some embodiments, the attachment means is disposed on the back surface of the housing

110. The pressure switch can be attached to the underside of the fire extinguisher handle via an attachment means (e.g., adhesive strip, hook-and-loop fastener, the like).

The fire extinguisher accessory device 100 may be constructed from a variety of materials. For example, in some embodiments, the fire extinguisher accessory device 100 is constructed from a material comprising a metal, a plastic, the like, or a combination thereof.

The disclosures of the following U.S. Patents are incorporated in their entirety by reference herein: U.S. Pat. No. 3,139,977; U.S. Pat. No. 7,044,295; U.S. Pat. No. 5,610,770; U.S. Pat. No. 5,366,073; U.S. Pat. No. 7,126,769; U.S. Pat. No. 5,999,336; U.S. Pat. No. 5,280,385; U.S. Pat. Application 200/0097507; U.S. Pat. No. 2005/0117229.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fire extinguisher accessory device for providing oral instructions for using a fire extinguisher, said fire extinguisher accessory device comprising a pressure pad, a microprocessor, a message controller and an amplifier, said pressure pad is operatively connected as input to said microprocessor;

wherein the pressure pad is located on the handle of the fire extinguisher;

wherein the pressure pad is actuated when the handle is compressed;

said microprocessor configured to:

receive input data from a pressure pad that is actuated;

generate an output control signal as the pressure pad is actuated, wherein the output control signal is operatively connected to said message controller, such that in response the pressure pad being actuated a pre-recorded message is reproduced over a speaker.

2. The fire extinguisher accessory device of claim 1 wherein the pre-recorded message says "pull safety pin, aim, spray and sweep".

3. The fire extinguisher accessory device of claim 1 wherein the pre-recorded message says "pull, aim, spray and sweep".

* * * * *